United States Patent [19]

Nakamura et al.

[11] Patent Number: 4,496,293

[45] Date of Patent: Jan. 29, 1985

[54] COMPRESSOR OF THE SCROLL TYPE

[75] Inventors: Toshiyuki Nakamura; Tsutomu Inaba; Tadashi Kimura, all of Wakayama, Japan

[73] Assignee: Mitsubishi Denki Kabushiki Kaisha, Tokyo, Japan

[21] Appl. No.: 450,551

[22] Filed: Dec. 16, 1982

[30] Foreign Application Priority Data

Dec. 28, 1981 [JP] Japan ..... 56-215823

[51] Int. Cl.[3] ..... F04B 39/06; F04C 18/02; F04C 29/04; H02K 9/00

[52] U.S. Cl. ..... 417/371; 417/902; 310/54; 418/5 S; 418/100

[58] Field of Search ..... 417/371, 366, 902; 418/5 S, 100, 86; 310/53, 54, 57, 59, 60 R, 60 A, 58, 55, 56

[56] References Cited

U.S. PATENT DOCUMENTS

| | | | |
|---|---|---|---|
| 2,661,146 | 12/1953 | Hill et al. | 310/58 |
| 3,525,001 | 8/1970 | Erickson | 417/371 |
| 4,065,279 | 12/1977 | McCullough | 418/5 S X |
| 4,115,035 | 9/1978 | Tankred et al. | 417/902 |

FOREIGN PATENT DOCUMENTS

| | | | |
|---|---|---|---|
| 547112 | 10/1957 | Canada | 417/371 |
| 1418046 | 12/1968 | Fed. Rep. of Germany . | |
| 1403513 | 5/1971 | Fed. Rep. of Germany . | |
| 2944198 | 5/1981 | Fed. Rep. of Germany . | |

*Primary Examiner*—Carlton R. Croyle
*Assistant Examiner*—T. Olds
*Attorney, Agent, or Firm*—Wenderoth, Lind & Ponack

[57] ABSTRACT

A compressor of the scroll type which includes a compression part and a motor to drive it, both received within a shell at upper and lower portions thereof, respectively, the compression part including a stationary and a movable scroll each having a convolute shape and associated with each other so as to form compression chambers therebetween, and disposed within the shell between the compression part and the motor is a frame that is formed therein with a hollow space in communication with a suction pipe which is arranged so as to pass through the shell, the hollow space being in communication through the air gap of the motor with a space formed within the shell below the motor, which is in turn in communication with the suction port of the compression part through the space formed between the motor and the shell and the passages formed in the frame.

8 Claims, 6 Drawing Figures

0°

270°

90°

180°

COMPRESSOR OF THE SCROLL TYPE

BACKGROUND OF THE INVENTION

The present invention relates to a compressor of the scroll type and more particularly to the constitution of the suction gas passage in a compressor of the scroll type.

It is well known that compressors of the scroll type have been used as compressors for compressing air, refrigerant, etc. FIGS. 1A to D of the attached drawings indicate fundamental constitutional elenents as well as the mode of operation of a compressor of this type. In the drawings the reference numeral 1 designates a stationary scroll, reference numeral 2 designates a movable scroll, reference numeral 3 designates a discharge port, and reference numeral 4 designates compressing chambers, and reference numeral 0 designates a definite point on stationary scroll 1 and reference numeral 0' designates a definite point on movable scroll 2, whereby in the drawings point 0 is adapted at the center of stationary scroll 1 and point 0' is at a point on a locus along which movable scroll 2 revolves around the center 0. Stationary and movable scrolls 1 and 2 each have a convolute shape of the same configuration which, as is well known in the art, may be involuted, or a combination of circular arcs, or the like although in the drawings it is assumed to be the involuted.

The operation of the compressor having the above constitution and as per se well known in the art is as follows.

In FIGS. 1A to D stationary scroll 1 is stationary relative to a point in space, and movable scroll 2 carries out a revolutional motion about a definite point 0 (the center of stationary scroll 1) without its attitude relative to the point in space being altered and maintaining contact of its convoluted walls with that of stationary scroll 1 as shown in the drawings. Thus, movable scroll 2 carries out the revolutional movement sequentially as shown in FIGS. 1A through D, designated 0°, 90°, 180° and 270°, respectively. Owing to the revolutional motion of movable scroll 2, compression chambers 4 each having the shape of substantially a crescent formed between the convolutions constituting stationary and movable scrolls 1 and 2, respectively, gradually decrease the volumes so that the gases taken into compression chambers 4 are continuously and sequentially compressed and discharged from discharge port 3. During this processes the distance between points 0 and 0' shown in FIGS. 1A to D is maintained constant, the distance 00' being formulated as $$00' = (a/2) - t,$$

wherein a is a distance between the convolutions and t is the thickness of the convoluted scroll walls, a corresponding to the pitch of the convolution.

Next, FIG. 2 shows an example of a conventional compressor of the scroll type in a cross-sectional representation in which is mounted the scrolls 1 and 2 shown in FIG. 1 as the main components. In FIG. 2 are shown the stationary scroll 1, the movable scroll 2, a vertical crankshaft 3, compression chambers 4, a frame 5 in which scrolls 1, 2 are mounted, an Oldham's coupling 6 to subject movable scroll 2 to a revolutional motion, motor rotor 7 securing crankshaft 3, a motor stator 8, a first balancer 9, a second balancer 10, the balancers 9 and 10 being secured to rotor 7, a shell 11 hermetically enclosing the above elements, a suction pipe 12 opened in the lower part of shell 11, a discharge pipe 13 connected to stationary scroll 1, an air gap 14 formed between rotor 7 and stator 8, suction passages 15 formed in frame 5, and an oil sump 16 at the bottom of shell 11.

Movable scroll 2 is fit within stationary scroll 1, the former being connected to crankshaft 3 which is fit in frame 5, frame 5 and stationary scroll 1 being fastened together by bolts or the like (not shown), and Oldham's coupling 6 is positioned between movable scroll 2 and frame 5. Motor rotor 7 is connected to crankshaft 3 through a press fit or the like, and first and second balancers 9 and 10 are secured to motor rotor 7 at the upper and lower ends, respectively, by screws or the like (not shown). Frame 5 and motor stator 8 are fixedly secured to shell 11 through a press fit or the like.

The operation of this compressor, which is well known per se in the art, is as follows.

Upon flowing an electric current through motor stator 8, rotational torque is generated in motor rotor 7 which rotates crankshaft 3. Therefore, although movable scroll 2 begins to rotate about stationary scroll 1, since its rotation is prevented by Oldham's coupling 6, movable scroll 2 revolves relative to stationary scroll 1 and they cooperate in compressing an operational fluid based on the compression principle as was described above in reference to FIGS. 1A to D, whereby movable scroll 2 performs an eccentric revolutional movement relative to stationary scroll 1, the static and dynamic balancing of movable scroll 2 being effected by first and second balancers 9 and 10.

Thus, when the compressor operates, the gas as the operational fluid is sucked from suction pipe 12 as shown by the solid arrows in FIG. 2, and after it is passed through flow passages such as air gap 14 formed between motor rotor 7 and motor stator 8, etc. and cools the motor, it is sucked into compression chambers 4 through suction passages 15 formed in frame 5 via a suction portion 4*a* of compression chambers 4, it being compressed there and discharged from discharge pipe 13.

As shown in FIG. 2 by the dotted arrows the lubricating oil is supplied to the relative shifting portions of a journal 2*a* formed between crankshaft 3 and movable scroll 2 and journals 3*b* and 3*c* formed between crankshaft 3 and frame 5, as well as to a thrust shifting portion 2*b* formed between movable scroll 2 and frame 5 by centrifugal force from oil sump 16 due to the fact that crankshaft 3 is formed with an axial eccentric passage 3*a* therethrough and the lower end thereof is dipped into the lubricating oil accumulated in oil sump 16, the lubricating oil leaked from the respective shifting portions is returned to oil sump 16 by gravity through air gap 14 between motor stator 8 and motor rotor 7.

In the conventional compressor of the scroll type having such a constitution as above described, the lubricant leaked from relative shifting portions 2*a*, 3*b*, 3*c* and 2*b* is sucked into compression chamber 4 along with the sucked gas without returning to the oil sump 16 and therefore discharge outside the compressor from discharge pipe 13. Therefore, the lubricant within oil sump 16 runs dry so that problems at shifting portions 2*a*, 3*b*, 3*c* and 2*b* due to seizure may occur. In order to prevent the loss of lubricant a costly oil separator is necessarily provided. Alternatively, if the suction gas is adapted to be sucked directly into compression chambers 4, without passing through air gap 14 the lubricant may be prevented from being sucked together with the gas, but this brings about another difficulty in that the motor cannot be cooled by the sucked gas.

OBJECTS AND SUMMARY OF THE INVENTION

It is an object of the present invention to provide a compressor of the scroll type which can eliminate the defects in a conventional compressor of the type described above.

It is another object of the present invention to provide a compressor of the scroll type which allows the sucked gas to cool the motor of the compressor and at the same time can effectively separate the lublicant oil within the compressor so that the problems of seizure of the relatively shifting portions of the compressor are prevented.

In accordance with the present invention a compressor of the scroll type is provided which comprises a compression part and a motor to drive it, both received within a shell, at respectively upper and lower positions thereof, the compression part stationary and movable scrolls each having a convolute shape and associated with each other to provide compression chambers therebetween, and disposed within the shell between the compression part and the motor is a disc shaped frame that is formed therein a hollow space in communication with a suction pipe which is arranged so as to be passed through the shell, the hollow space being in communication with a space formed within the shell below the motor through the air gap formed between the stator and the rotor of the motor, and the space below the motor is in communication with the suction port of the compression part through a space formed between the motor and the inner surface of the shell.

BRIEF DESCRIPTION OF THE DRAWINGS

Other objects of the present invention and the invention itself will become more apparent from the following detailed description and the appended drawings, in which.

DESCRIPTION OF THE PREFERRED EMBODIMENT

Figure 1A:
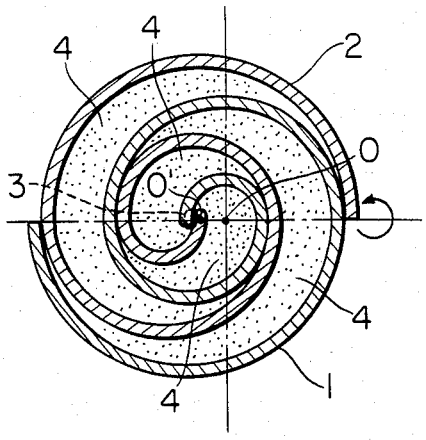
FIGS. 1A to D are diagrams indicating an operational principle of a compressor of the scroll type.
Figure 1D:
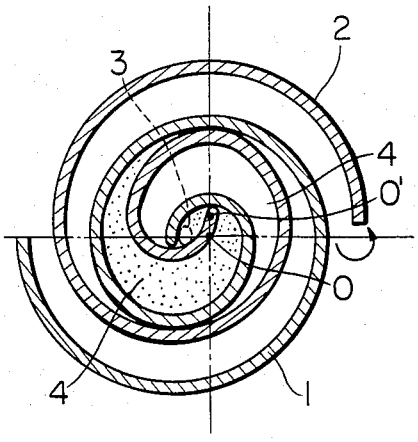
Figure 1B:
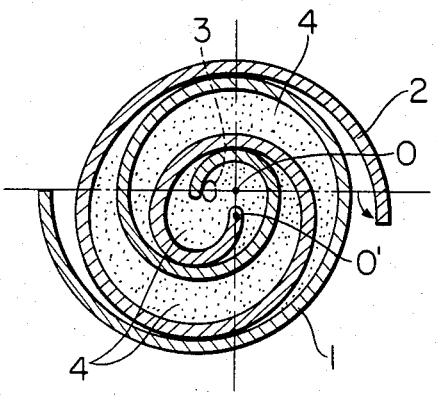
Figure 1C:
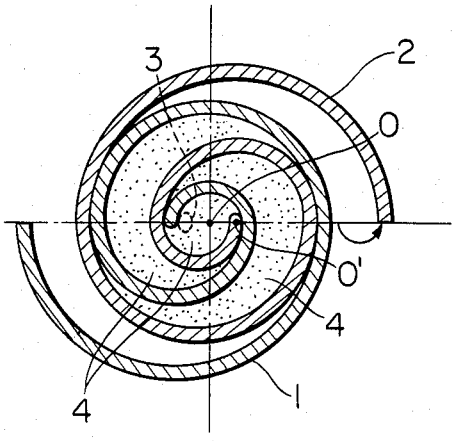
Figure 2:
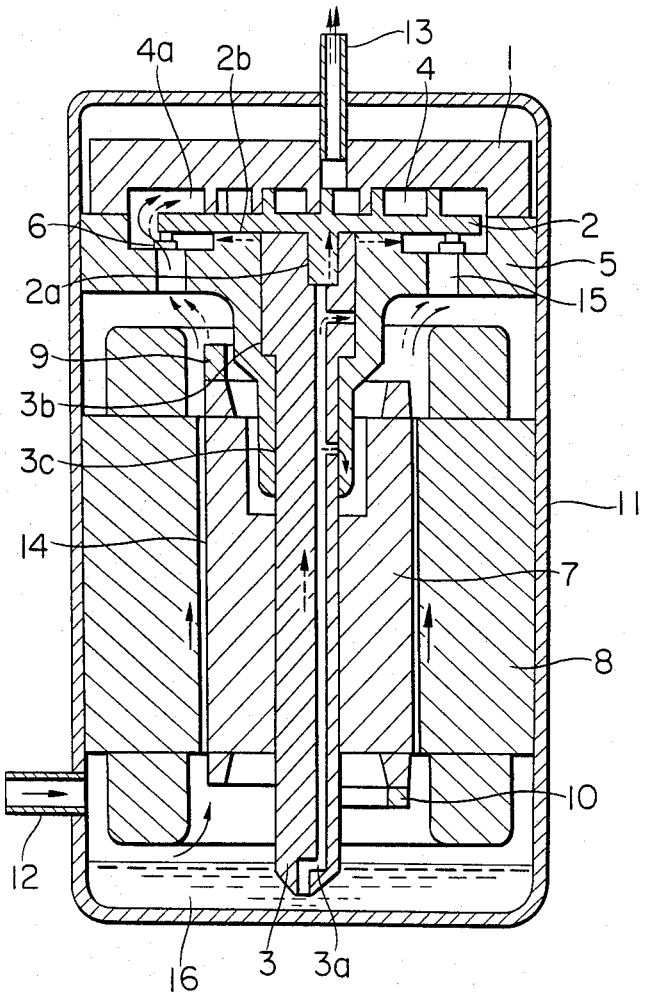
FIG. 2 PRIOR ART
FIG. 2 is a longitudinal sectional view of a conventional compressor of the scroll type.
Figure 3:
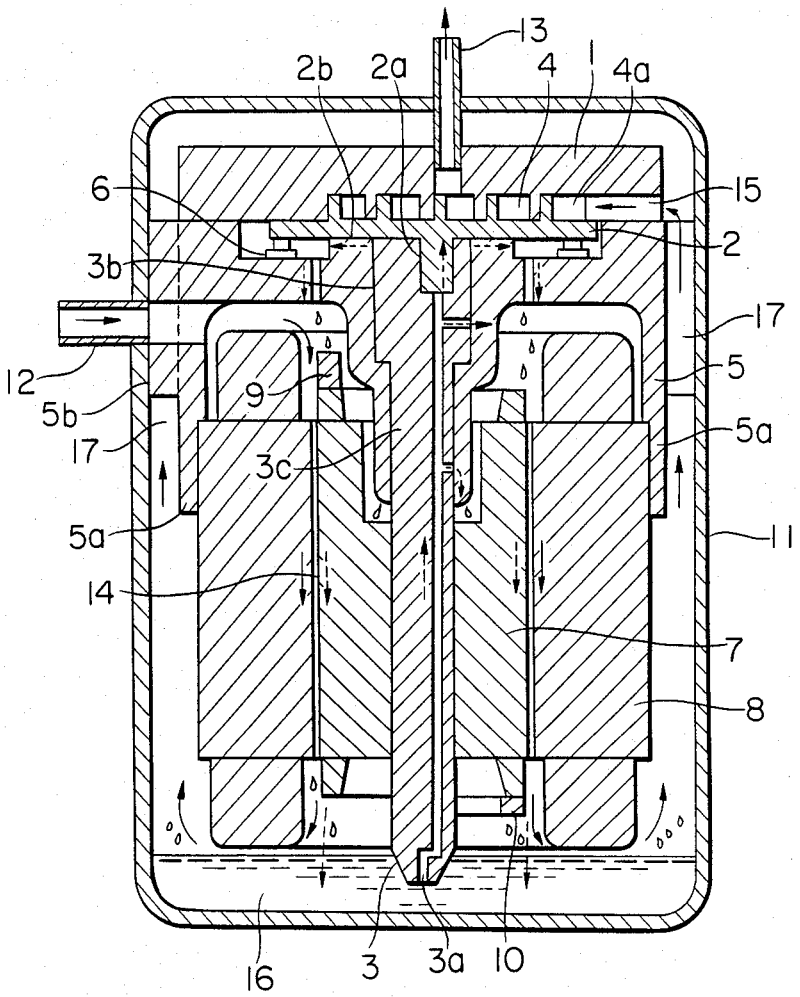
FIG. 3 is a longitudinal sectional view of one embodiment of the compressor of the scroll type according to the present invention.

Referring now to FIG. 3 of the attached drawings there is shown an embodiment of the present invention in a longitudinal sectional view wherein the parts identical or similar to those in a conventional compressor as shown in FIG. 2 bear the same reference numerals as in FIG. 2.

As shown in FIG. 3 a frame 5 not only supports at its central portion a crankshaft 3, but also supports at its lower peripheral portion 5*a* a motor stator 8 at its upper end portion by force fit or the like, and frame 5 itself is mounted within a hermetical shell 11 with the outer peripheral portion 5*b* of frame 5 being force fit into shell 11 or the like. A suction pipe 12 extends through shell 11 to be directly connected to frame 5 so as to be in communication with the upper portion of a motor chamber formed between the inside of frame 5 and motor stator 8, a suction port 15 of the compression part being provided at the outer periphery of a stationary scroll 1. A plurality of flow passages 17 are provided at the abutting portion of the outer peripheral portion 5*b* of frame 5 with the inner periphery of shell 11 so that suction port 15 of the compression part communicates with the lower portion of the motor chamber through flow passages 17.

Thus, with a compressor in accordance with the present invention, as shown in FIG. 3 by the solid arrows the suction gas is guided from suction pipe 12 to the upper portion of the motor chamber formed between the inside of frame 5 and the upper part of motor stator 8, and thence flows through an air gap 14 formed between rotor 7 and stator 8 of the motor, to the lower portion of the motor chamber, then flowing upwards after the moving direction thereof is changed by 180°. At this point it will be appreciated that the lubricant oil which leaks from relative shifting portions 2*a*, 3*b*, 3*c* and 2*b* flow downwards as shown by the dashed arrows together with the sucked gas also flowing downwards as shown by the solid arrows. The gas, after passed through communicating passages 17, is guided to compressing chambers 4 through suction port 15 via a suction part 4*a*. The lubricant which leaks from the relative shifting portions is carried with the suction gas which is sucked from suction pipe 12 and flows down air gap 14 and is returned to the oil sump 16 when the suction gas changes its direction through 180° at the lower portion of the motor.

Although a single preferred embodiment of the present invention has been described and illustrated, it will be understood by those skilled in the art that modifications may be made in the structure, form and relative arrangement of parts without necessarily departing from the spirit and the scope of the present invention.

What is claimed is:

1. A compressor of the scroll type comprising a compression part including a stationary and a movable scroll each having a convolute shape and contacting one another so as to form compressing chambers, including a suction portion, therebetween; a motor to drive said movable scroll; a shell containing said compression part and said motor and having an oil sump at the bottom thereof; a frame separating the inside of said shell into said compression part and a motor chamber containing said motor, said frame being provided therein with an upper portion of said motor chamber and means, including an inlet passage respectively communicating at opposite ends with the exterior of said compressor and with said upper portion of said motor chamber, delivering a suction gas through said inlet passage into said upper portion of said motor chamber; and means for guiding the suction as from said upper portion of said motor chamber downward into said oil sump and then upward from said oil sump to said suction portion of said compression part; said delivering means and said suction gas guiding means including means for preventing the suction gas passing through said inlet passage from flowing into said oil sump before being delivered to said upper portion of said motor chamber and from passing into said suction portion of said compression part before passing into said oil sump.

2. A compressor of the scroll type as claimed in claim 1 wherein said motor has a rotor and a stator and said guiding means comprises said upper portion of said motor chamber; an annular air gap, formed between the stator and the rotor of said motor, in communication with said upper portion; a ring shaped space, formed between the inner periphery of said shell and the outside of said stator of said motor, in communication with said annular air gap; and communication passages formed in said frame so as to connect said ring shaped space with said suction portion of said compression part.

3. A compressor of the scroll type as claimed in claim 2, wherein said oil sump is in fluid communication with said annular air gap such that suction gas guided downward in said air gap carries oil therein into said oil sump.

4. A compressor of the scroll type as claimed in claim 1, wherein said frame comprises an outer peripheral portion outside said suction gas compressing chambers, said guiding means comprising a plurality of flow passages at said outer peripheral portion communicating with said suction portion of said compression part and said oil sump, for guiding said suction gas between said oil sump and said suction portion of said compression part.

5. A compressor of the scroll type as claimed in claim 1, further comprising an Oldham's coupling coupled to said movable scroll beneath said movable scroll, for revolving said movable scroll, and means for guiding lubricant in said Oldham's coupling downward into said oil sump.

6. A compressor of the scroll type as claimed in claim 5, wherein said suction gas guiding means and said lubricant guiding means includes means for guiding lubricant and suction gas together from said upper portion of said motor chamber downward into said oil sump.

7. A compressor of the scroll type as in claim 1, wherein:

said motor has a motor rotor, a motor stator and a crankshaft, to drive said movable scroll through said crankshaft;

said frame within said shell having a central portion, a lower portion, and a force fit portion, force fit into said shell at said force fit portion, said frame supporting said crankshaft at said central portion and supporting said motor stator at said lower portion;

said compressor further comprising a discharge pipe communicating with the exterior of said shell and said compressing chambers so as to guide compressed gas from said compressing chambers to the exterior of said shell, one of said discharge pipe and said delivering means opening into said shell at said force fit portion, the other of said discharge pipe and said delivering means passing through said shell and being connected to said stationary scroll; and said suction gas guiding means including a lubricant passage formed between said motor rotor and said motor stator, for guiding lubricant downward into said oil sump.

8. A compressor of the scroll type as claimed in claim 7, further comprising an Oldham's coupling coupled to said movable scroll beneath said movable scroll, for revolving said movable scroll, and lubricant guiding means, including said lubricant passage, for guiding lubricant in said Oldham's coupling downward into said oil sump.

* * * * *